US006345967B1

(12) United States Patent
Mukai et al.

(10) Patent No.: US 6,345,967 B1
(45) Date of Patent: Feb. 12, 2002

(54) SCROLL TYPE FLUID MACHINE HAVING DIFFERENT WRAP SIDE SURFACE CLEARANCES

(75) Inventors: Yuugo Mukai, Tsuchiura; Isamu Tsubono, Chiyoda; Isao Hayase, Tsuchiura; Takeshi Tsuchiya, Chiyoda; Toshiyuki Terai, Oohira; Mutsunori Matsunaga, Shimizu, all of (JP)

(73) Assignee: Hitachi, Ltd., Trustee for Benefit of Air Conditiong Systems Co., Ltd., Tokyo (JP)

( * ) Notice: Subject to any disclaimer, the term of this patent is extended or adjusted under 35 U.S.C. 154(b) by 0 days.

(21) Appl. No.: 09/599,739

(22) Filed: Jun. 23, 2000

(30) Foreign Application Priority Data

Jun. 23, 1999 (JP) ..... 11-176655

(51) Int. Cl.[7] ..... F01C 1/04
(52) U.S. Cl. ..... 418/55.2
(58) Field of Search ..... 418/55.2

(56) References Cited

U.S. PATENT DOCUMENTS 4,382,754 A * 5/1983 Shaffer et al. ..... 418/55.2
4,490,099 A * 12/1984 Terauchi et al. ..... 418/55.2
5,427,512 A * 6/1995 Kohsokabe et al. ..... 418/55.2

FOREIGN PATENT DOCUMENTS

JP 60-37319 * 8/1985
JP 64-63682 * 3/1989
JP 3-11102 * 1/1991
JP 5-223071 * 8/1993
JP 8-254191 * 10/1996

* cited by examiner

*Primary Examiner*—John J. Vrablik
(74) *Attorney, Agent, or Firm*—Antonelli, Terry, Stout & Kraus, LLP

(57) ABSTRACT

The invention provides a scroll type fluid machine in which a performance is improved by improving assembling accuracy and reliability is improved by giving strength to wraps. The scroll type fluid machine is provided with an orbiting scroll having an end plate and a wrap stood on the end plate, and a fixed scroll having an end plate and a wrap stood on the end plate and structured such that a motion within a surface perpendicular to an axial direction is restricted, thereby reducing or expanding a volume formed by engaging the wraps of the fixed scroll and the orbiting scroll with each other so as to close between both of the scrolls. In the scroll type fluid machine, a side surface clearance formed between both of the wraps is formed to be smaller in a range between a central winding start point of the wrap and a section close to a center of the wrap than in a range between the section close to the center of the wrap and a section close to an outer periphery of the wrap.

7 Claims, 6 Drawing Sheets

SCROLL TYPE FLUID MACHINE HAVING DIFFERENT WRAP SIDE SURFACE CLEARANCES

BACKGROUND OF THE INVENTION

The present invention relates to a scroll type fluid machine which is a kind of a displacement type fluid machine.

In a fixed crank type scroll fluid machine in which an amount of eccentricity is fixed and an orbiting radius of an orbiting scroll is defined, and therefore, a fixed scroll itself or a member for defining a position of the fixed scroll is fixed to a compressor base main body of a chamber. As a method of fixing the fixed scroll at a time of assembling, for example, there is an extremely simple method in which the orbiting scroll is orbited while a crank shaft is rotated at a low speed and screws for fixing are gradually fastened while determining that a position at which contact is the least is an optimum position. In this case, except in an oil free machine, a lubricating oil is poured into a clearance so as to form an oil film, thereby preventing wraps from being excessively brought into contact with each other.

Then, in accordance with this method, since an assembled state is a state that a crank shaft rotates when an assembly is completed, a shift of the fixed scroll from an ideal position is equal to or less than a size of a clearance of side surfaces between both of the wraps (a clearance of a portion where the fixed scroll wrap and the orbiting scroll wrap are close to each other so as to form a seal when placing the orbiting scroll at the orbiting position), so that an average performance level is not reduced.

On the contrary, in a variable crank type in which an amount of eccentricity is variable, described in JP-B2-60-37319, the assembling method mentioned above cannot be employed, and therefore, an assembling jig having a high accuracy or the like is required, so that a high cost is required for manufacturing and processing.

In this case, as a structure in which an orbiting bearing portion is not arranged close to a center of the orbiting wrap and which absorbs a thermal deformation at a time of operation, for example, there is listed up a structure described in JP-A-8-254191.

In the scroll type fluid machine of the fixed crank type, an assembling accuracy is improved in comparison with the variable crank type, and therefore, there is obtained an advantage that an average performance level is improved, however, it is necessary to take the following points into consideration.

In the scroll type fluid machine, a change close to an adiabatic change of expansion and compression of fluid is generated between both of the scrolls, and therefore, temperature level of both of the scrolls at a time of operation is different from the other portions and an amount of thermal expansion becomes different from the other portions. The fixed scroll has a lot of contact portions which are in contact with portions other than the orbiting scroll in comparison with the orbiting scroll, so that a free thermal expansion is prevented at the contact portions. Accordingly, at a time of operation, relatively, only the orbiting scroll varies in size. In the fixed crank type in which the orbiting bearing or the orbiting shaft is arranged close to the center of the wrap, the orbiting bearing or the orbiting shaft is combined with an eccentric portion of the crank shaft and the position of the center portion of the orbiting scroll is defined, and therefore, an amount of deformation due to the thermal expansion is increased from the center portion toward an outer periphery.

Both of the scrolls become in an engagement state as shown in FIGS. 7 and 8 due to the thermal expansion.

That is, an amount of reduction is increased as being close to an outer periphery of the wrap, that is, the clearance of side surfaces becomes reduced as being close to the outer periphery, at a clearance between an outer side surface of the orbiting wrap and an inner side surface of the fixed wrap of an X spiral portion in an eccentric side in the case of a compressor in which an orbiting scroll 1 thermally expands relatively due to an increase of temperature (refer to FIG. 7), and at a clearance between an inner side surface of the orbiting wrap and an outer side surface of the fixed wrap of a Y spiral portion in an opposite eccentric side in the case of an expansion machine in which the orbiting scroll 1 thermally contracts relatively due to a reduction of temperature (refer to FIG. 8). As a result, a risk that the wraps are interfered with each other (both of the scroll wraps are mechanically brought into contact with each other) can be considered.

Accordingly, conventionally, in order to avoid this risk of interference, that is, in order to prevent the scroll wraps on an outer peripheral side from being brought into contact with each other at a time of thermal expansion, the clearance between both of the wraps is previously increased. In particular, the amount of eccentricity of the fixed crank shaft is set to be smaller than an amount determined in accordance with a shape of the wrap (an ideal value of the orbiting radius). As a result, at a time of assembling upon which there is no thermal deformation, the clearance between the wrap side surfaces is increased. No consideration has been given to a matter that a positioning error of the fixed scroll at a time of assembling increases, the error being determined on the basis of the magnitude of the clearance. That is, no consideration has been given to a matter that dispersion is generated in an assembling accuracy between the orbiting scroll and the fixed scroll, thereby reducing an average performance level.

SUMMARY OF THE INVENTION

An object of the present invention is to provide a scroll type fluid machine in which a performance is improved by improving an assembling accuracy (first object) and reliability is improved by giving strength to wraps (second object).

In order to achieve the first object, in accordance with the present invention, there is provided a scroll type fluid machine comprising:

- an orbiting scroll having an end plate and a wrap stood on the end plate and orbiting within a surface perpendicular to an axial direction in a direction that the wrap is stood without rotating on its own axis;
- a fixed scroll having an end plate and a wrap stood on the end plate and structured such that a motion within the surface perpendicular to the axial direction is restricted; and
- a crank mechanism having a fixed amount of eccentricity, the crank mechanism being provided for orbiting the orbiting scroll, thereby reducing or expanding a volume formed by engaging the wraps of the fixed scroll and the orbiting scroll with each other so as to close between both of the scrolls,
  - wherein a side surface clearance formed between both of the wraps is formed to be smaller in a range between a central winding start point of the wrap and a section close to a center of the wrap than in a range between the section close to the center of the wrap and a section close to an outer periphery of the wrap, and an orbiting shaft coupled with the orbiting scroll side and the section close to the center of the wrap have an overlapping portion as seen from an axial direction.

More preferably, the section close to the center of the wrap is in a range of 360° from the central winding start portion of the wrap.

Only the side surface clearance of the section close to the center of the wrap is narrowed with keeping the clearance of the section close to the outer periphery of the wrap, in which the reduction amount of the side surface clearance between the wraps is large at a time of operation, in a magnitude at a time of assembling. Therefore, it is possible to avoid a risk that the wraps are interfered with each other at a time of operation. A position adjusting operation acting from the orbiting scroll to the fixed scroll or the positioning member of the fixed scroll is generated in the section close to the center, where the side surface clearance between the wraps is made small, at an assembling time during which the fixed scroll or the positioning member of the fixed scroll are gradually fixed by screws while rotating the crank shaft, and therefore, an assembling accuracy can be improved and it is possible to increase an average performance level.

Further, since the section close to the center of the wrap is set to 360° from the central winding start portion of the wrap, the portion which can be position adjusting action in each of the side surfaces inside and outside the wrap of the orbiting scroll is limited to one portion within the section close to the center of the wrap, even if the crank shaft is in any rotational phase. Accordingly, the position adjusting action becomes continuously in accordance with the rotation of the crank shaft except the case of moving to the winding start portion of the wrap or the case of moving between the inner curve and the outer curve of the wrap, and therefore, it is possible to prevent an impulsive position adjusting action from being generated and prevent the fixed scroll from generating an unnecessary vibration, whereby an assembling accuracy can be improved.

Further, in order to achieve the second object, in accordance with the present invention, there is provided a scroll type fluid machine comprising:

an orbiting scroll having an end plate and a wrap stood on the end plate and orbiting within a surface perpendicular to an axial direction in a direction that the wrap is stood without rotating on its own axis;

a fixed scroll having an end plate and a wrap stood on the end plate and structured such that a motion within the surface perpendicular to the axial direction is restricted; and a crank mechanism having a fixed amount of eccentricity, the crank mechanism being provided as drive means for orbiting the orbiting scroll, thereby reducing or expanding a volume formed by engaging the wraps of the fixed scroll and the orbiting scroll with each other so as to close between both of the scrolls, wherein an orbiting shaft coupled with the orbiting scroll side and a section close to a center of the wrap have an overlapping portion as seen from an axial direction, a side surface clearance formed between both of the wraps is formed to be smaller in a range between a central winding start point of the wrap and the section close to the center of the wrap than in a range between the section close to the center of the wrap and a section close to an outer periphery of the wrap, and a formula B−A>>C−D is established when setting an average of a wall thickness in the section close to the outer periphery of the wrap (except a winding end portion of the wrap) to A, an average of a wall thickness in the section close to the center of the wrap (except a winding start portion of the wrap) to B, a side surface clearance in the section close to the outer periphery of the wrap to C and a side surface clearance in the section close to the center of the wrap to D.

In accordance with the means mentioned above, it is possible to give a strength to the section close to the center of the wrap where a force is applied via an oil film at a time of operation at a high possibility, thereby improving reliability of both of the wraps.

DESCRIPTION OF THE PREFERRED EMBODIMENTS

A description will be given below of an embodiment in accordance with the present invention with reference to FIGS. 1 to 4.

Figure 1:
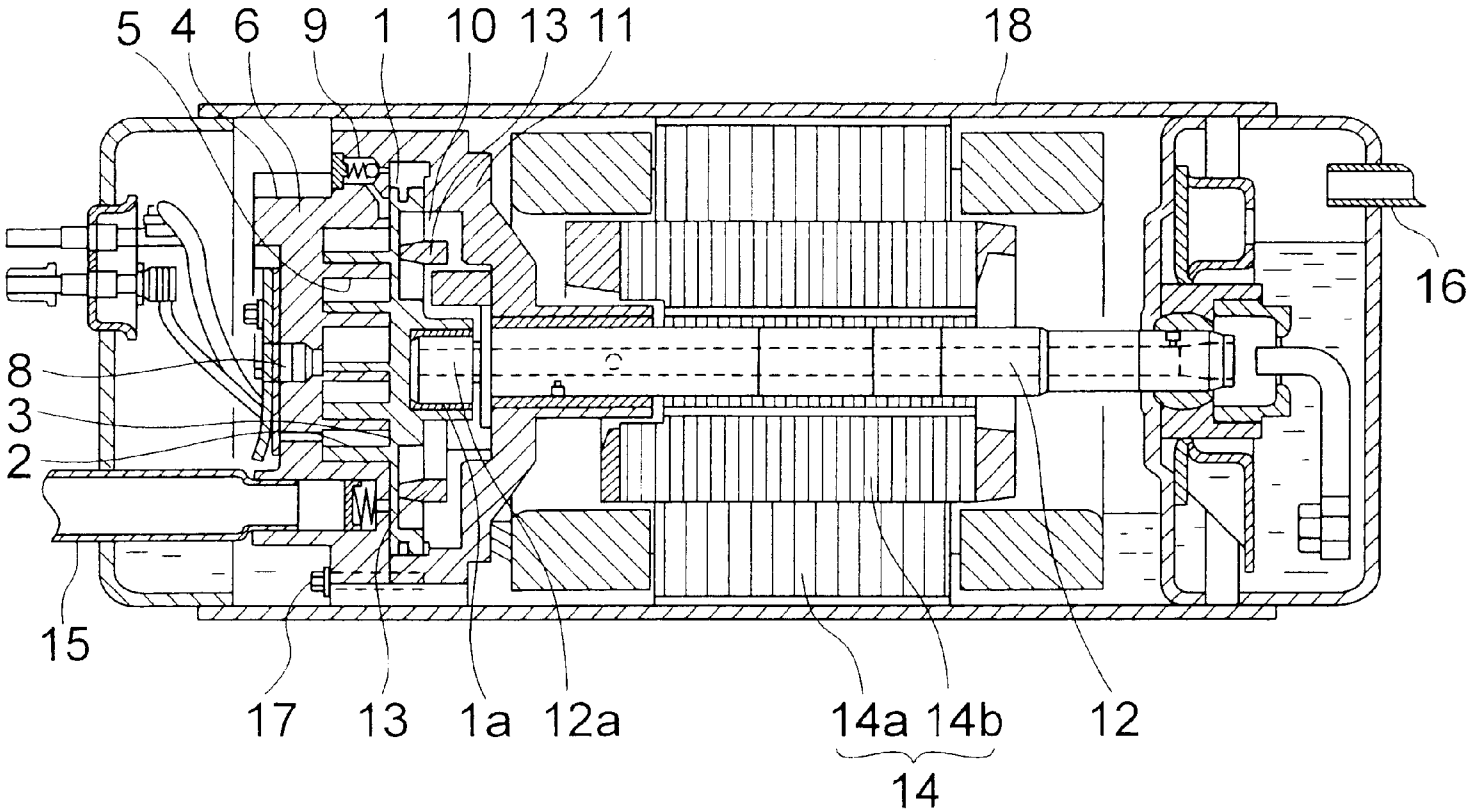
FIG. 1 is a cross sectional view of an embodiment of a scroll type fluid machine in accordance with the present invention.
Figure 2A:
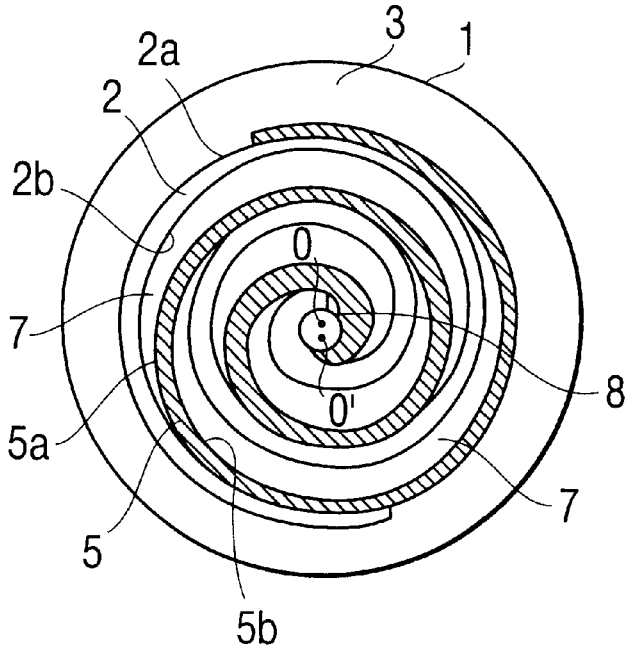
FIG. 2A is a plan view of a whole of wraps of the scroll type fluid machine shown in FIG. 1
Figure 2B:
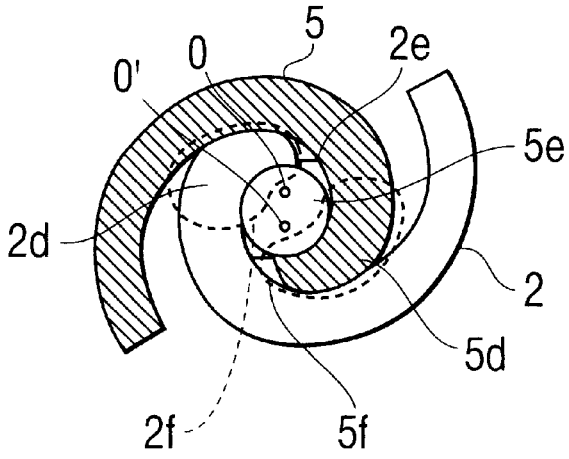
FIG. 2B is a detailed view of a winding start portion of the wrap.
Figure 3:
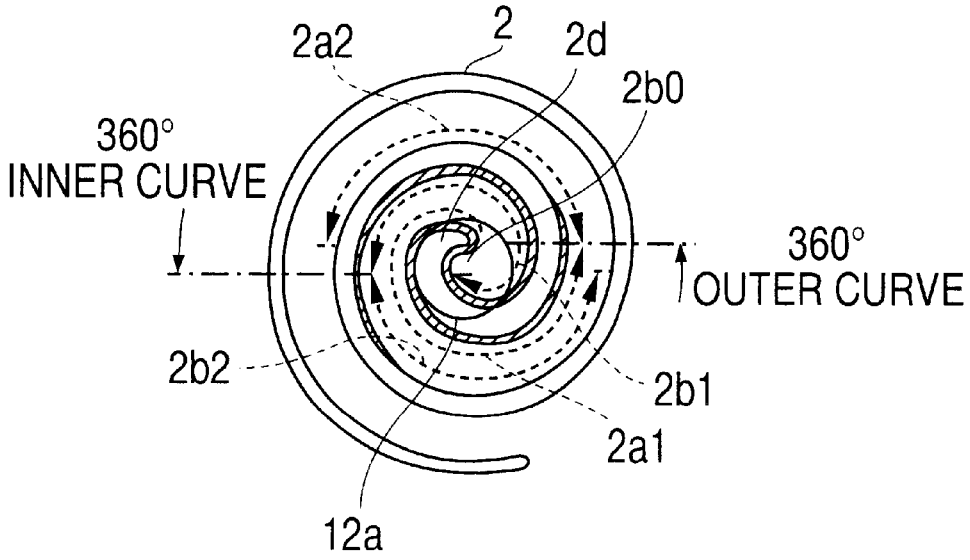
FIG. 3 is a plan view, which shows a thick portion of the wrap.
Figure 4:
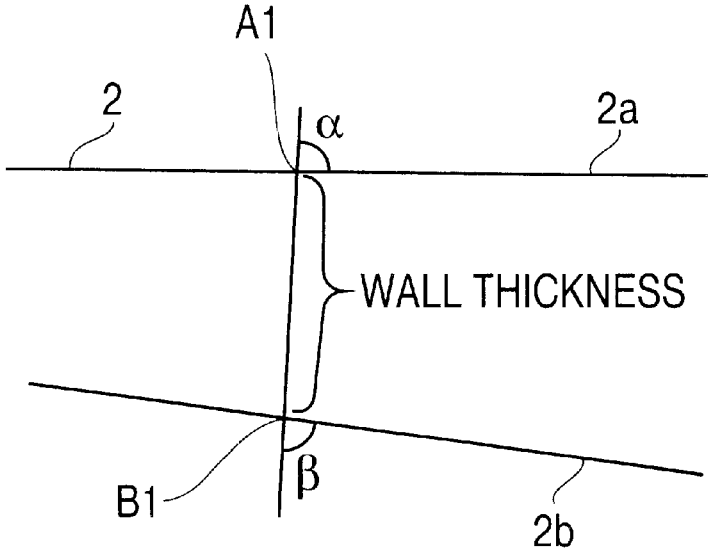
FIG. 4 is a schematic view of the thick portion of the wrap.
Figure 5A:
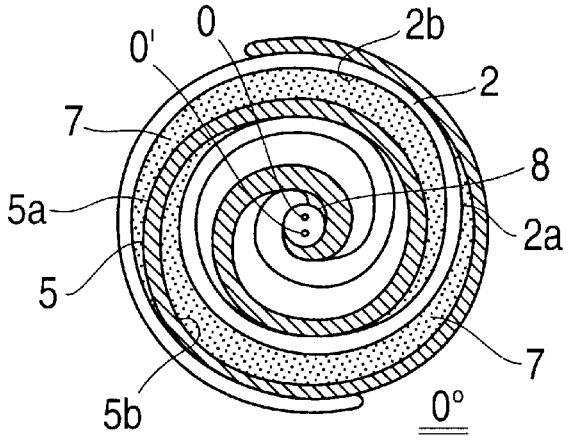
FIGS. 5A to 5D are plan views which show a positional relationship and an operational principle of both of the wraps in the case of employing the scroll type fluid machine as a compressor.
Figure 5B:
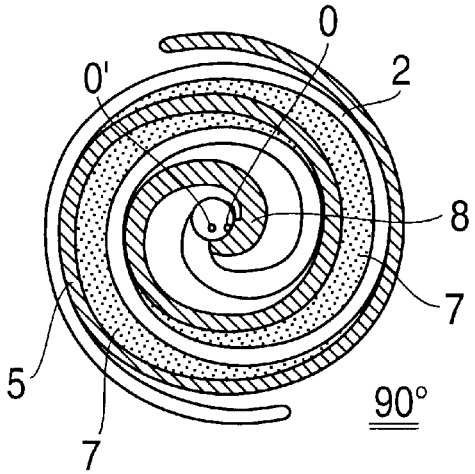
Figure 5C:
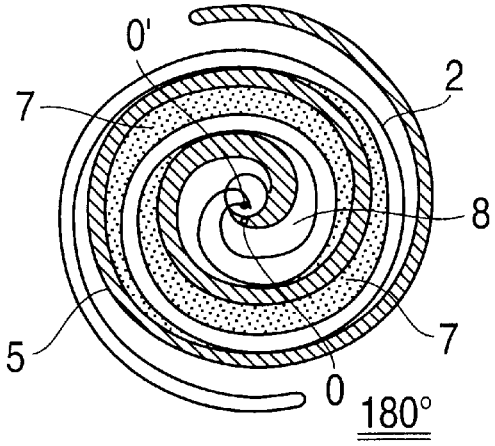
Figure 5D:
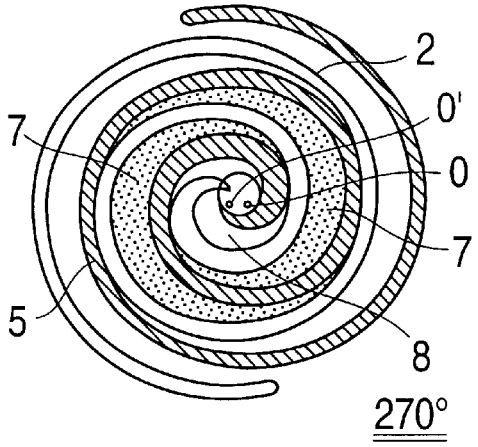

FIG. 1 is a cross sectional view of an embodiment of a scroll type fluid machine in accordance with the present invention, FIG. 2A is a plan view of a whole of wraps, FIG. 2B is a detailed view of a winding start portion of the wrap, FIG. 3 is a plan view which shows a thick portion of the wrap, and FIG. 4 is a plan view which shows a positional relationship and an operational principle of both of the wraps in the case of employing the scroll type fluid machine as a compressor.

In FIGS. 1 and 2A, reference numeral 1 denotes an orbiting scroll, which is constituted by an orbiting side wrap 2 and an end plate 3, and the orbiting side wrap 2 is formed by an orbiting outer curve 2*a* and an orbiting inner curve 2*b*. Reference numeral 4 denotes a fixed scroll, which is constituted by a fixed side wrap 5 and an end plate 6, and the fixed side wrap 5 is formed by a fixed outer curve 5*a* and a fixed inner curve 5*b*. A side surface clearance formed by both of these wraps 2 and 5 is structured such that a side surface clearance in a section close to a center is smaller than a side surface clearance in a section close to an outer periphery in the other sections.

Reference numeral 7 denotes a working chamber formed between the orbiting side wrap 2 and the fixed side wrap 5, and reference numeral 8 denotes a discharge port from which a compressed fluid is flowed out. Reference symbol O denotes a center of the orbiting scroll 1, and reference symbol O' denotes a center of the fixed scroll 4. Reference numeral 9 denotes a control valve apparatus, which is structured to control so that a pressure of an intermediate pressure chamber 10 has a fixed pressure difference with respect to a suction pressure. The intermediate pressure chamber 10 applies a suitable pressure from a back surface of the orbiting scroll 1 so as to form the working chamber 7 having a reduced mechanical loss and leakage loss due to a sliding operation between the orbiting scroll 1 and the fixed scroll 4.

An orbiting shaft 12*a* of a crank shaft 12 supported by a frame 11 is inserted to an orbiting bearing 1*a* formed on the back surface of the orbiting scroll 1. Further, an Oldham's ring 13 allowing a revolution motion of the orbiting scroll 1 but preventing a rotation motion thereof is arranged between the frame 11 and the orbiting scroll 1. Reference numeral 14 denotes a motor, which is constituted by a stator 14*a* and a rotor 14*b* and is provided for driving the crank shaft 12. Reference numeral 15 denotes a suction pipe, which is provided for taking in a fluid such as a refrigerant gas or the like, and reference numeral 16 denotes a discharge pipe, which is provided for discharging a compressed fluid. Reference numeral 17 denotes a fixing bolt, which is provided for fixing the fixed scroll 4 to the frame 11. Reference numeral 18 denotes a hermetic case, in which the orbiting scroll 1, the fixed scroll 4 and the motor 14 are received in a sealed manner.

A description will be given below of an operation of the scroll type fluid machine having a structure mentioned above.

The crank shaft 12 is rotated by energizing the motor 14, the orbiting scroll 1 revolves without rotating around its axis by the Oldham's ring 13, and the fluid sucked into the suction pipe 15 is compressed between the orbiting scroll 1 and the fixed scroll 4 as shown in FIG. 4.

That is, a volume of the working chamber 7 between both of the wraps 2 and 5 is reduced from a state (a) 0° where a suction of fluid is finished, to (b) 90°, (c) 180° and (d) 270° where the revolution moves forward in this order so as to perform a fluid compressing operation.

The compressed fluid is discharged into the hermetic case 18 of the compressor from the discharge port 8, and finally the fluid is discharged out of the compressor from the discharge pipe 16. In this compressing operation, since the side surface clearance in the section close to the center of the wrap among the side surface clearances between the wraps 2 and 5 is made smaller than the side surface clearance in the section close to the outer periphery of the wrap in the other sections, it is possible to restrict an internal leakage of the fluid generated near the center portion of the wrap where an internal pressure difference is large, so that a performance of the compressor is improved.

Hereinafter, the reason why by making the side surface clearance in the section close to the center of the wrap smaller than the side surface clearance in the section close to the outer periphery of the wrap in the other sections, it is possible to restrict an internal leakage of the fluid generated near the center portion of the wrap having a large internal pressure difference, so that an assembling performance of the compressor is improved will be described in detail.

At first, with respect to the wrap, a description will be given of winding start portions of the orbiting side wrap 2 and the fixed side wrap 5, and a winding start point of the wrap with reference to FIGS. 2A and 2B.

In a winding start portion (a portion surrounded by a broken line) 2*d* of the orbiting side wrap 2, an outer curve 2*a* starts being wound from a winding start point 2*e*, and an inner curve 2*b* starts being wound from a winding start point 2*f*. In a winding start portion (a portion surrounded by a broken line) 5*d* of the fixed side wrap 5 shown by a hatched line, an outer curve 5*a* starts being wound from a winding start point 5*f*, and an inner curve 5*b* starts being wound from a winding start point 5*e*.

A description will be given of a thick portion of the wrap with reference to FIG. 3.

FIG. 3 shows the orbiting side wrap 2, however, since the same matters can be applied to the fixed side wrap 5, description will be given with taking the case of the orbiting side wrap 2.

When in a polar coordinates, setting a radius vector to r, an amplitude to θ, a coefficient of an algebraic spiral curve to a, and an index of the algebraic spiral curve to k, a basic spiral curve can be expressed by the following formula 1.

$$r=a\cdot\theta^{k} \tag{1}$$

The inner curve and the outer curve of the wrap are formed by the basic spiral curve or an envelope of curves obtained by offsetting the basic spiral curve. A wall thickness is gradually reduced from the center portion of the orbiting side wrap 2 toward the outer periphery of the wrap so as to obtain a thin thickness.

That is, the thick portion shown by the hatched line is made thick (generally, between about some μm and about some hundreds μm) in a range between the winding start point of the wrap and 360° , by making the outer curve 2*a* of the wrap to a curve shown by a broken line 2*a*1 and the inner curve 2*b* to a curve shown by a broken line 2*b*1. Further, the wall thickness is returned to an original thickness by gradually reducing the thickness in a range between 360° and 540° (measured by setting a first lap to 360° and a second lap to 720° with reference to the winding start point), that is, from the first lap toward about further 180°, by making the outer curve 2*a* and the inner curve 2*b* respectively, to lines shown by broken lines 2*a*2 and 2*b*2.

If the thick portion in the section close to the center of the wrap is widely extended beyond 360°, a working portion serving as a position adjusting action on both of the side surfaces of the wraps 2 is generated at every 360° sections with a certain rotational phase of the crank shaft 12, however, since, in fact, only one of them acts as position adjusting action and is determined in accordance with an adjusting condition such as shape accuracy of the wrap 2, a screw fastening degree at a time of assembling the fixed scroll 4 or screwing the fixed scroll positioning member, and the like, it is actually impossible to estimate what portion it is. Accordingly, possibility that a working portion of the position adjusting action discontinuously moves with rotation of the crank shaft 12 becomes high, and an impact force is easily generated, thereby increasing an unnecessary vibration of the fixed scroll 4 and reducing assembling accuracy.

Accordingly, if the thick portion extends in a range wider than the range mentioned above, for example, about a range of 450° from the winding start portion of the wrap, improved assembling accuracy can be obtained, because the shape of the wrap in such range is not so different from that in the range from the winding start portion of the wrap to 360°.

On the contrary, if the thick portion in the section close to the center of the wrap extends in a range widely narrower than 360°, there is generated a case that all of the portions which can be the working portion for position adjusting action are gathered to a position out of the section close to the center of the wrap with a certain rotational phase of the crank shaft 12. Therefore, the possibility that the working portion for the position adjusting action discontinuously moves with the rotation of the crank shaft 12 becomes high, and similarly, the impact force is easily generated, thereby increasing an unnecessary vibration of the fixed scroll 4 and reducing assembling accuracy.

Accordingly, if the thick portion extends in a range slightly narrower than the range of 360°, for example, about a range of 250° from the winding start portion of the wrap, improved assembling accuracy can be obtained as far as a change rate is not increased on the way to reduce an amount of thickness and to return to the original thickness.

Further, a desired effect can be obtained even when a range to reduce the thickness to the original thickness is not set in a range of 180° and the thickness is gradually reduced till the winding end portion of the wrap.

In this case, FIG. 3 shows that the orbiting shaft 12*a* coupled with the orbiting scroll and the section close to the center of the wrap 2 have an overlapping portion as seen from an axial direction, that is, the winding start portion 2*d* of the orbiting side wrap 2 exists within the orbiting shaft 12*a* shown by a solid circle.

In this case, the wall thickness will be described by taking the case of the orbiting side wrap 2. The wall thickness is a length of line between A1 and B1 in which angles $\alpha$ and $\beta$ formed by the outer curve 2*a* and the inner curve 2*b* of the wrap 2 and the line are equal to each other as shown in FIG. 4.

In short, the first object is achieved by making the side surface clearance formed between the wraps in the range between the central winding start portion of the wrap and the section close to the center of the wrap smaller than the side surface clearance in the range between the section close to the center of the wrap and the section close to the outer periphery of the wrap. A preferable range of the range between the central winding start portion of the wrap and the section close to the center of the wrap is a range of being equal to or more than 250° and equal to or less than 450° from the central winding start portion of the wrap. More preferable range is a range of 360° from the central winding start portion of the wrap. The side surface clearance in the range is made to be substantially uniform and smaller than the side surface clearance in the section close to the outer periphery of the wrap.

In this case, as the structure of making the wrap in the center portion thick, U.S. Pat. No. 5,427,512 and JP-A-3-11102 are known. However, the side surface clearance is made uniform from the winding start of the wrap to the winding end of the wrap. These have the same problems as those of the prior art.

Further, in order to give strength to the wrap so as to improve reliability, the relation between the wall thickness and the side surface clearance is set as follows.

A difference between an average of the wall thickness except the winding end portion in the section close to the outer periphery of both of the wraps and an average of the wall thickness except the winding start portion of the wrap in the section close to the center of both of the wraps is set to be sufficiently larger than a difference between the side surface clearances in the section close to the outer periphery of the wrap and the section close to the center of the wrap. That is, when setting an average of the wall thickness in the section close to the outer periphery of the wrap (in this case, the winding end portion of the wrap is excluded) to A, an average of the wall thickness in the section close to the center of the wrap (in this case, the winding start portion of the wrap is excluded) to B, a side surface clearance in the section close to the outer periphery of the wrap to C and a side surface clearance in the section close to the center of the wrap to D, the formula B−A>>C−D is established.

The orbiting scroll 1 and the fixed scroll 4 are assembled in the following manner.

At first, the fixed side wrap 5 and the orbiting side wrap 2 are combined with pouring a lubricating oil therebetween, and the fixed scroll 4 is temporarily fastened to the frame 11 by the fixing bolt 17 in a loosened manner. The wraps are made by the crank shaft 12 so that a center O of the orbiting scroll revolves with an orbiting radius e (=OO') without rotating around a center O' of the fixed scroll. Even in the case that the fixed side wrap 5 is not at a predetermined optimum position, a position adjusting action acts to the fixed side wrap 5 via an oil film from the orbiting side wrap 2 at the section close to the center.

Next, an assembly is completed at a position where differences from the optimum position of the fixed side wrap 5 and the orbiting side wrap 2 become minimum, by gradually fastening the temporarily fastened fixing bolt 17 while revolving the orbiting side wrap 2 around the fixed side wrap 5.

The above operation will be described in detail hereinafter. The optimum position between the fixed side wrap 5 and the orbiting side wrap 2 is a position where a revolution can be performed in a lightest manner when revolving the orbiting side wrap 2.

In the case that the side surface clearance is uniform as in the prior art, a position where both wraps are brought into contact with each other when revolving the orbiting side wrap 2 for assembling varies in accordance with a grinding process error. For example, in the case that the outer peripheral side of the wrap is processed thick within an allowable error range, the wraps are brought into contact with each other on the outer periphery thereof. On the contrary, when the inner side of the wrap (the center side of the wrap) is processed thick, the wraps are brought into contact with each other at the center side of the wrap. With this, there is a problem that assembling accuracy varies in dependent on the products.

Meanwhile, when an indication, for example, an indication (a design value ±0.05) is output, accuracy of grinding process is determined within the range of ±0.05.

In the present embodiment, the side surface clearance is reduced by making the thickness of the winding start portion of the wrap thick. The thickness of the winding start portion of the wrap is made thicker than the winding end portion of the wrap and required tolerance with respect to the machine for performing the grinding process is not changed. Accordingly, accuracy in the winding start portion of the wrap becomes relatively high. Since the side surface clearance in the winding start side of the wrap which has high process accuracy is made narrow, the winding start sides of the wraps are brought into contact with each other at a time of assembling and the positioning is performed here, so that assembling accuracy is improved and accuracy dispersion at every products is reduced.

Then, in the case that both of the wraps are in pressure contact and engaged with each other via the oil film in the section close to the center of the wrap, the performance reduction is generated due to a sliding friction. However, in order to avoid this, at least one of the wraps 2 and 5 may be coated with a film having excellent lubrication performance so as to reduce the pressure contact. With this, it is possible to restrict dispersion of performance and reliability caused by a difference of the processing accuracy.

Further, since the wall thickness in the section close to the center of the wrap where the larger force than the section close to the outer periphery of the wrap is applied is thick, strength of the wrap is improved.

Further, since the wall thickness is thick in the section close to the center of the wrap in which the working chamber having a large pressure difference is formed, a length of a flow passage between an addendum of the wrap and a deddendum of the other wrap, so that a seal performance is improved so and internal leakage can be restricted.

Further, since both sides of the center side of the orbiting side wrap are substantially uniformly made thick only in a range of 360°, an assembling accuracy of the orbiting scroll and the fixed scroll is improved and a performance level of the compressor is improved.

In accordance with the present embodiment, it is possible to provide a compressor, which restricts a dispersion of the performance, prevents the performance level from being reduced in an average manner, and is excellent in a performance and reliability.

In this case, only the section close to the center of the orbiting side wrap 2 is made thick, however, the fixed side wrap 5 may be made thick, and further, both of the wraps may be of course made thick.

Further, in place of making the section close to the center of the orbiting side wrap 2 or the fixed side wrap 6 thick, the section close to the outer periphery of the orbiting side wrap 2 or the fixed side wrap 6 may be made thin.

Further, in the case that at least one of the orbiting scroll and the fixed scroll is made of a material having a high coefficient of thermal expansion, there is a risk that an interference is generated in the section close to the outer periphery of the wrap, however, a risk of interference is reduced by applying the wrap mentioned above, so that assembling accuracy of both of the wraps can be improved.

Further, description is given by taking the case of the high pressure chamber type compressor as the scroll type fluid machine, however, in addition, the present invention can be applied to an expansion machine and a pump, and can be also applied to a low pressure chamber type scroll type fluid machine.

Further, the algebraic spiral curve expressed by the formula 1 is employed for the basic spiral curve of the wrap, however, the present invention can be applied to a wrap constituted by an involute or the other curves.

Figure 6:
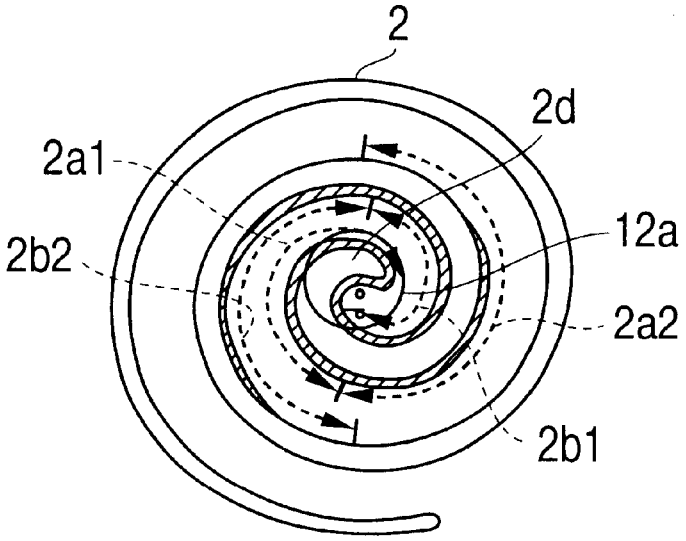
FIG. 6 is a view, which shows an embodiment employing an involute curve of a circle for the wrap.
Figure 7:
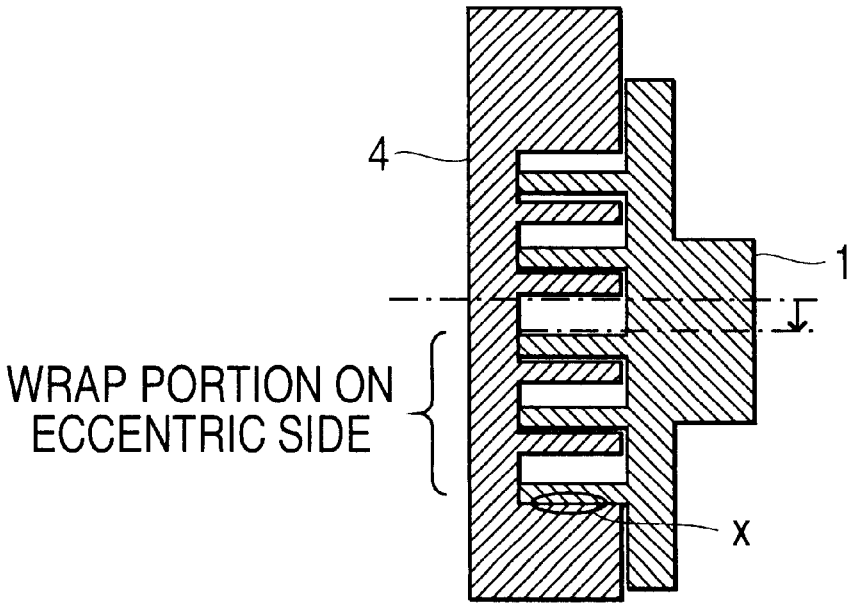
FIG. 7 is a view which explains an interference of the wraps in a compressor in which an orbiting scroll is thermally expanded in a relative manner.
Figure 8:
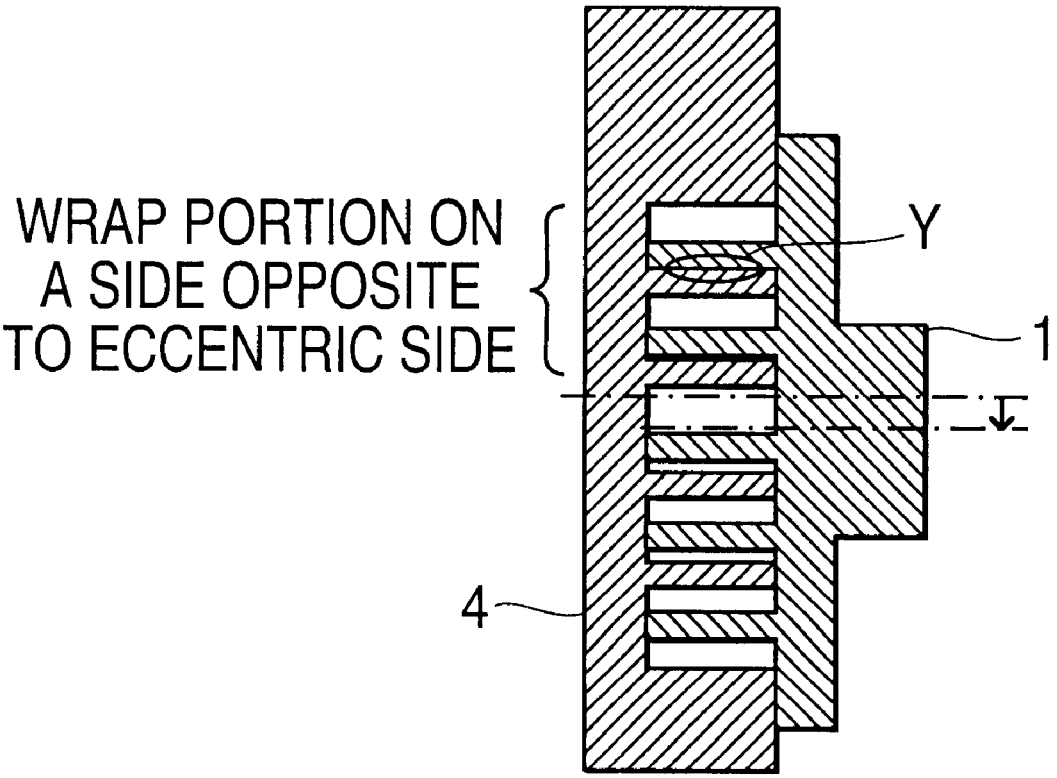
FIG. 8 is a view, which explains an interference of the wraps in a compressor in which an orbiting scroll is thermally contracted in a relative manner.

FIG. 6 shows an embodiment of a wrap employing an involute curve of a circle. An outer side and an inner side of the section close to the center of the orbiting side wrap 2 is made thick (hatched portion). That is, the wrap is made thick in a range of 260° from the winding start point of the wrap as shown by an outer curve 2*a*1 and an inner curve 2*b*1 of the orbiting side wrap 2, and thereafter, an amount of thickness is gradually reduced in a range (180°) shown by an outer curve 2*a*2 and an inner curve 2*b*2 to the original wall thickness.

In the wrap employing the involute curve of the circle, in the case of a shape not made thick, it is possible to process in accordance with a method in which while a work piece is rotated at constant speed, an end mill is moved at a constant speed onto a straight line which is positioned with a process offset valve equal to a radius of a base circle shifted from a center of the rotation of the work piece from a feature of the curve. Therefore, the shape where the side surface clearance changes can be processed by changing only the process offset value, whereby software for a NC machine for processing can be easily changed.

In this case, in the same manner as that in FIG. 3, there is shown the matter that the orbiting shaft 12*a* coupled with the orbiting scroll side and the section close to the center of the wrap 2 have the overlapping portion as seen from an axial direction, that is, the winding start portion 2*d* of the orbiting side wrap 2 exists within the orbiting shaft 12*a* shown by a solid circle.

In this case, it is possible to make the winding start side of the wrap thin so as to make the side surface clearance smaller than the outer periphery of the wrap. In this case, it is a matter of course that the processing accuracy of the winding start side of the wrap should be made high.

In accordance with the present invention, it is possible to provide a scroll type fluid machine which can be assembled so that both of the wraps of the orbiting scroll and the fixed scroll have substantially the optimum positional relation so as to restrict dispersion of the performance due to the assembling error, and the performance level can be improved in an average manner.

Further, it is possible to provide a scroll type fluid machine in which the wrap is excellent in strength by making the thickness of the wall thicker in the section close to the center of the wrap where the risk of interference between the wrap side surfaces is high, thereby obtaining high reliability.

What is claimed is:

1. A scroll type fluid machine comprising:

an orbiting scroll having an end plate and a wrap stood on the end plate and orbiting within a surface perpendicular to an axial direction in a direction that the wrap is stood without rotating on its own axis;

a fixed scroll having an end plate and a wrap stood on the end plate and structured such that a motion within the surface perpendicular to the axial direction is restricted; and a crank mechanism having a fixed amount of eccentricity, said crank mechanism being provided for orbiting said orbiting scroll, thereby reducing or expanding a volume formed by engaging the wraps of said fixed scroll and said orbiting scroll with each other so as to close between both of the scrolls, wherein a side surface clearance formed between both of said wraps is formed to be smaller in a range between a central winding start point of the wrap and a section close to a center of the wrap than in a range between the section close to the center of the wrap and a section close to an outer periphery of the wrap, and an orbiting shaft coupled with said orbiting scroll and said section close to the center of the wrap have an overlapping portion as seen from an axial direction.

2. A scroll type fluid machine comprising:

an orbiting scroll having an end plate and a wrap stood on the end plate and orbiting within a surface perpendicular to an axial direction in a direction that the wrap is stood without rotating on its own axis;

a fixed scroll having an end plate and a wrap stood on the end plate and structured such that a motion within the surface perpendicular to the axial direction is restricted; and a crank mechanism having a fixed amount of eccentricity, said crank mechanism being provided as drive means for orbiting said orbiting scroll, thereby reducing or expanding a volume formed by engaging the wraps of said fixed scroll and said orbiting scroll with each other so as to close between both of the scrolls, wherein a wall thickness of at least one of said wraps is made thicker in a range between a central winding start point of the wrap and a section close to a center of the wrap than in a range between the section close to the center of the wrap and a section close to an outer periphery of the wrap, and an orbiting shaft coupled with said orbiting scroll and said section close to the center of the wrap have an overlapping portion as seen from an axial direction.

3. A scroll type fluid machine as claimed in claim 2, wherein the wall thickness of said thickened wrap is gradually made thin in said section close to the outer periphery of the wrap and is returned to the wall thickness before being made thick.

4. A scroll type fluid machine as claimed in claim 1 or 2, wherein said section close to the center of the wrap is in a range being equal to or more than 250° and equal to or less than 450° from the central winding start point of the wrap.

5. A scroll type fluid machine as claimed in claim 1 or 2, wherein said section close to the center of the wrap is in a range of 360° from the central winding start portion of the wrap.

6. A scroll type fluid machine as claimed in claim 1 or 2, wherein, the side surface clearance formed by both of the wraps is made substantially uniform in said section close to the center of the wrap.

7. A scroll type fluid machine comprising:

an orbiting scroll having an end plate and a wrap stood on the end plate and orbiting within a surface perpendicular to an axial direction in a direction that the wrap is stood without rotating on its own axis;

a fixed scroll having an end plate and a wrap stood on the end plate and structured such that a motion within the surface perpendicular to the axial direction is restricted; and a crank mechanism having a fixed amount of eccentricity, said crank mechanism being provided as drive means for orbiting said orbiting scroll, thereby reducing or expanding a volume formed by engaging the wraps of said fixed scroll and said orbiting scroll with each other so as to close between both of the scrolls, wherein an orbiting shaft coupled with said orbiting scroll and said section close to the center of the wrap have an overlapping portion as seen from an axial direction, a side surface clearance formed between both of said wraps is formed to be smaller in a range between a central winding start point of the wrap and a section close to a center of the wrap than in a range between the section close to the center of the wrap and a section close to an outer periphery of the wrap, and a formula $B-A>>C-D$ is established when setting an average of a wall thickness in the section close to the outer periphery of the wrap (except a winding end portion of the wrap) to A, an average of a wall thickness in the section close to the center of the wrap (except a winding start portion of the wrap) to B, a side surface clearance in the section close to the outer periphery of the wrap to C and a side surface clearance in the section close to the center of the wrap to D.

* * * * *

UNITED STATES PATENT AND TRADEMARK OFFICE

CERTIFICATE OF CORRECTION

PATENT NO. : 6,345,967 B1
DATED : February 12, 2002
INVENTOR(S) : Yuugo Mukai et al.

It is certified that error appears in the above-identified patent and that said Letters Patent is hereby corrected as shown below:

Title page,
Item [73], Assignee, replace "Hitachi, Ltd., trustee for Benefit of Air Conditioning Systems Co., Ltd." with -- Hitachi, Ltd., trustee for the Benefit of Hitachi Air Conditioning Systems Co., Ltd. --.

Signed and Sealed this

Twelfth Day of November, 2002

*Attest:*

*Attesting Officer*

JAMES E. ROGAN
*Director of the United States Patent and Trademark Office*